US006257201B1

(12) United States Patent
Kajiura et al.

(10) Patent No.: US 6,257,201 B1
(45) Date of Patent: Jul. 10, 2001

(54) EXHAUST BRAKE

(75) Inventors: Mikihiro Kajiura, Tokyo (JP); Noriomi Hosaka, Novi, MI (US); Noboru Egashira, Kanagawa (JP)

(73) Assignee: Unisia Jecs Corporation, Atsugi (JP)

( * ) Notice: Subject to any disclaimer, the term of this patent is extended or adjusted under 35 U.S.C. 154(b) by 0 days.

(21) Appl. No.: 09/468,849

(22) Filed: Dec. 22, 1999

(30) Foreign Application Priority Data

Dec. 24, 1998 (JP) ..... 10-367334

(51) Int. Cl.[7] ..... F01L 13/06; F02D 13/04
(52) U.S. Cl. ..... 123/321; 123/90.16
(58) Field of Search ..... 123/321, 320, 123/322, 90.12, 90.16, 90.17, 90.39, 123, 323

(56) References Cited

U.S. PATENT DOCUMENTS 5,809,952 * 9/1998 Ono et al. ..... 123/90.16
5,975,251 * 11/1999 McCarthy ..... 123/321
6,000,374 * 12/1999 Cosma et al. ..... 123/321
6,032,643 * 3/2000 Hosaka et al. ..... 123/321

FOREIGN PATENT DOCUMENTS 9-184407 7/1997 (JP) .
2000-186518 * 7/2000 (JP) .

* cited by examiner

*Primary Examiner*—Henry C. Yuen
*Assistant Examiner*—Hieu T. Vo
(74) *Attorney, Agent, or Firm*—Foley & Lardner

(57) ABSTRACT

An exhaust brake is incorporated with an internal combustion engine. The brake comprises an exhaust rocker arm actuated by an exhaust cam for operating an exhaust valve; a brake rocker arm actuated by a brake cam; a first contacting unit held by either one of the exhaust and brake rocker arms; a second contacting unit held by the other of the exhaust and brake rocker arms. The second contacting unit is contactable with the first contacting unit when an exhaust braking is needed. Only when the brake rocker arm is actuated by the brake cam upon need of the exhaust braking, there induces the contact between the second and first contacting units, which provides an integral action of the exhaust and brake rocker arms thereby to actuate the exhaust valve for establishing the exhaust braking.

9 Claims, 6 Drawing Sheets

EXHAUST BRAKE

BACKGROUND OF THE INVENTION

1. Field of the Invention

The present invention relates in general to brakes provided by automotive internal combustion engines, and more particularly to engine brakes of a compression release type, that is, usually called exhaust brakes.

2. Description of the Prior Art

The compression release type exhaust brake is a brake wherein each exhaust valve of the engine is crack opened at the end of each compression stroke when the brake is in operation. That is, when the exhaust valve is crack opened at the end of the compression stroke, part of compressed gas in the combustion chamber is exhausted. Thus, in the subsequent expansion stroke, repulsion applied to the piston is lowered due to reduction of the gas in the combustion chamber. Furthermore, since, after effecting the crack opening, the exhaust valve is kept closed during the expansion stroke, the combustion chamber produces a resistance against the movement of the piston toward a lower dead center. Thus, in the expansion stroke, the force for rotating the crankshaft in a normal direction is reduced resulting in that the engine rotation is lowered or braked.

In order to appropriately operate each exhaust valve in the above-mentioned manner, Japanese Patent First Provisional Publication 9-184407 proposes a mechanism including an exhaust rocker arm which is swingably actuated by an exhaust cam for operating the exhaust valve, a brake rocker arm which is swingably actuated by a brake cam and a coupling structure through which the two rocker arms are operatively coupled. That is, under normal operation of the engine, the exhaust valve is actuated by only the exhaust rocker arm, and upon need of the exhaust braking, the coupling structure couples the two rocker arms causing the exhaust valve to be actuated by the brake rocker arm as well as the exhaust rocker arm.

However, due to its inherent construction, the above-mentioned conventional exhaust brake fails to exhibit a satisfied function. That is, in this conventional exhaust brake, during the operation, the associated engine is subjected to a marked change in inertia mass of a valve actuating mechanism between two cases, one being a brake case wherein the brake rocker arm is in operation for effecting the exhaust braking and the other being a normal case wherein the brake rocker arm is not in operation. Such marked change tends to induce a non-smoothed movement of the exhaust valve.

SUMMARY OF THE INVENTION

It is therefore an object of the present invention to provide an exhaust brake which is free of the above-mentioned drawback.

According to the present invention, there is provided an exhaust brake incorporated with an internal combustion engine. The exhaust brake comprises an exhaust rocker arm actuated by an exhaust cam for operating an exhaust valve; a brake rocker arm actuated by a brake cam; a first contacting unit held by either one of the exhaust and brake rocker arms; a second contacting unit held by the other of the exhaust and brake rocker arms, the second contacting unit being contactable with the first contacting unit when an exhaust braking is needed; and a coupling structure which, only when the brake rocker arm is actuated by the brake cam upon need of the exhaust braking, induces the contact between the second and first contacting units to provide an integral action of the exhaust and brake rocker arms thereby to actuate the exhaust valve for establishing the exhaust braking.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

In the following, the present invention will be described in detail with reference to the accompanying drawings.

For ease of understanding, directional terms, such as, right, left, up, down, rightward, leftward and the like are used in the description. However, these terms are to be understood with respect to the drawings on which corresponding parts or structures are illustrated.

Figure 4:
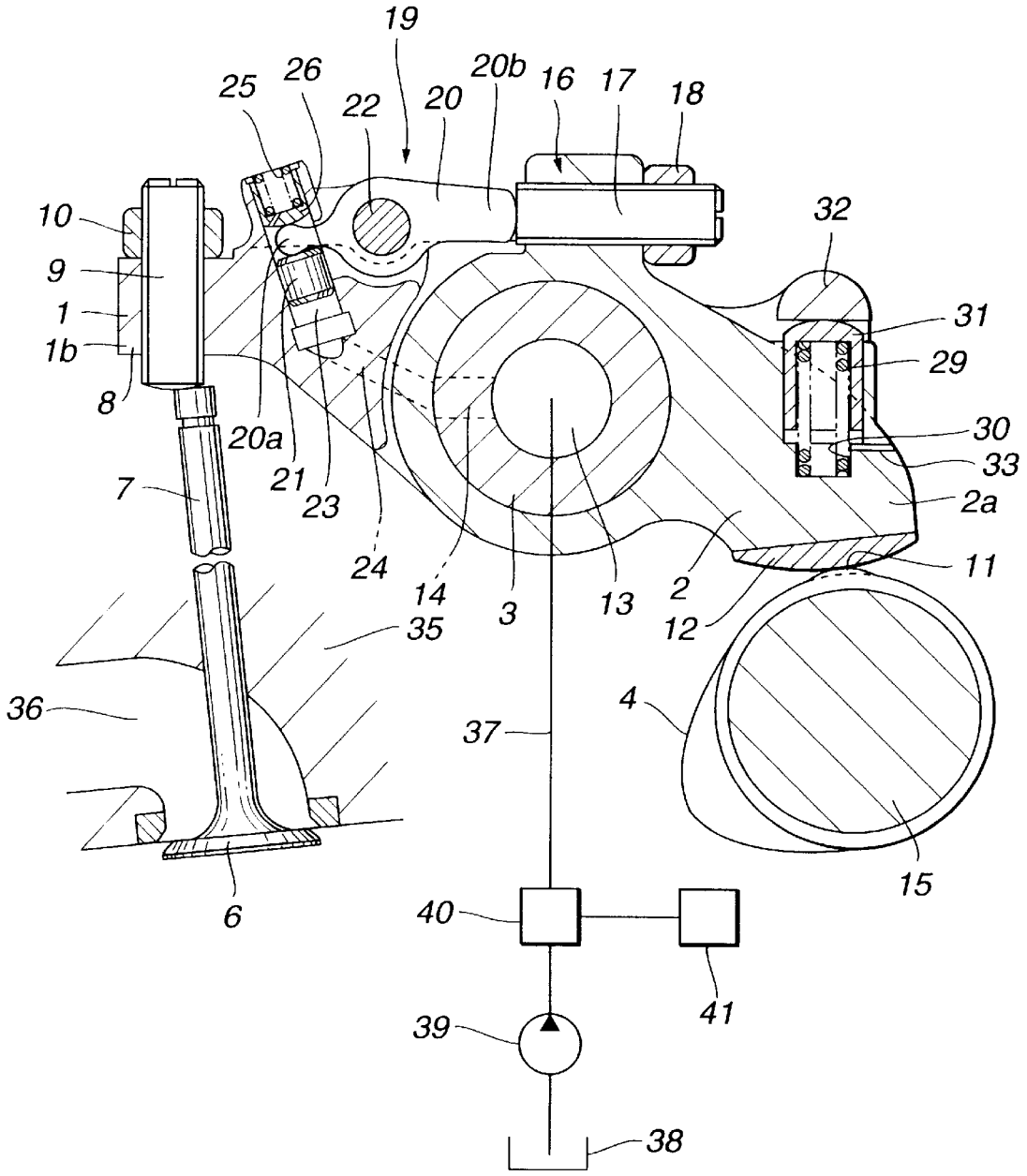
FIG. 4 is a sectional view of the exhaust brake practically incorporated with a brake cam and a brake rocker arm, showing a condition wherein with the second contacting unit being in operation, an exhaust valve is slightly opened for effecting the exhaust braking.

Referring to the drawings, particularly FIG. 4, there is shown an exhaust brake of the present invention practically incorporated with parts of an internal combustion engine.

In the drawing, designated by numeral 1 is an exhaust rocker arm, and 2 is a brake rocker arm. These two arms 1 and 2 are incorporated with each combustion cylinder of an internal combustion engine. These two rocker arms 1 and 2 are pivotally supported by a rocker shaft 3.

Figure 6:
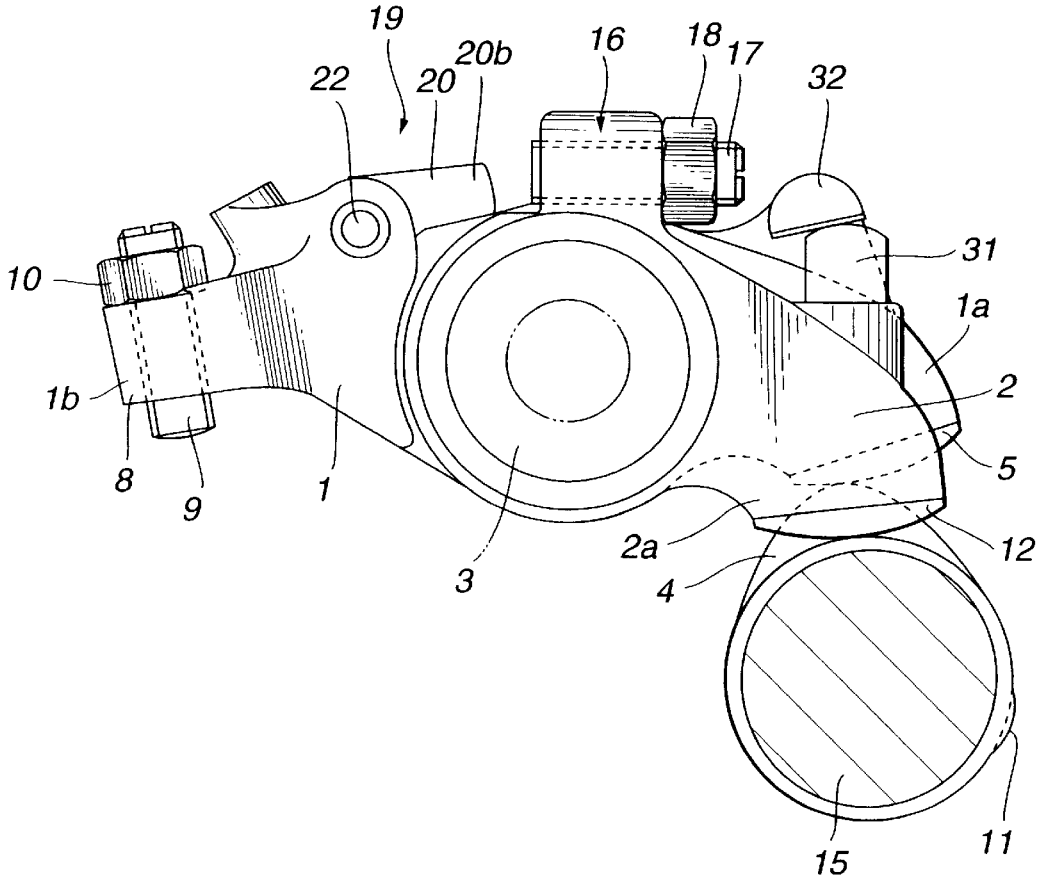
FIG. 6 is a view similar to FIG. 4, but showing a condition wherein with the second contacting unit being in operation, an exhaust cam pivots an exhaust rocker arm.

As is seen from FIG. 6, a right end la of the exhaust rocker arm 1 is formed with a cam follower 5 which contacts an exhaust cam 4. While, a left end 1*b* of the exhaust rocker arm 1 is formed with a screw supporting portion 8 equipped with an adjusting screw 9 which contacts a valve stem 7 (see FIG. 4) of an exhaust valve 6 incorporated with an exhaust passage 36 formed in a cylinder head 35. A nut 10 is engaged with the adjusting screw 9 for adjusting a space between the adjusting screw 9 and the valve stem 7.

Figure 1:
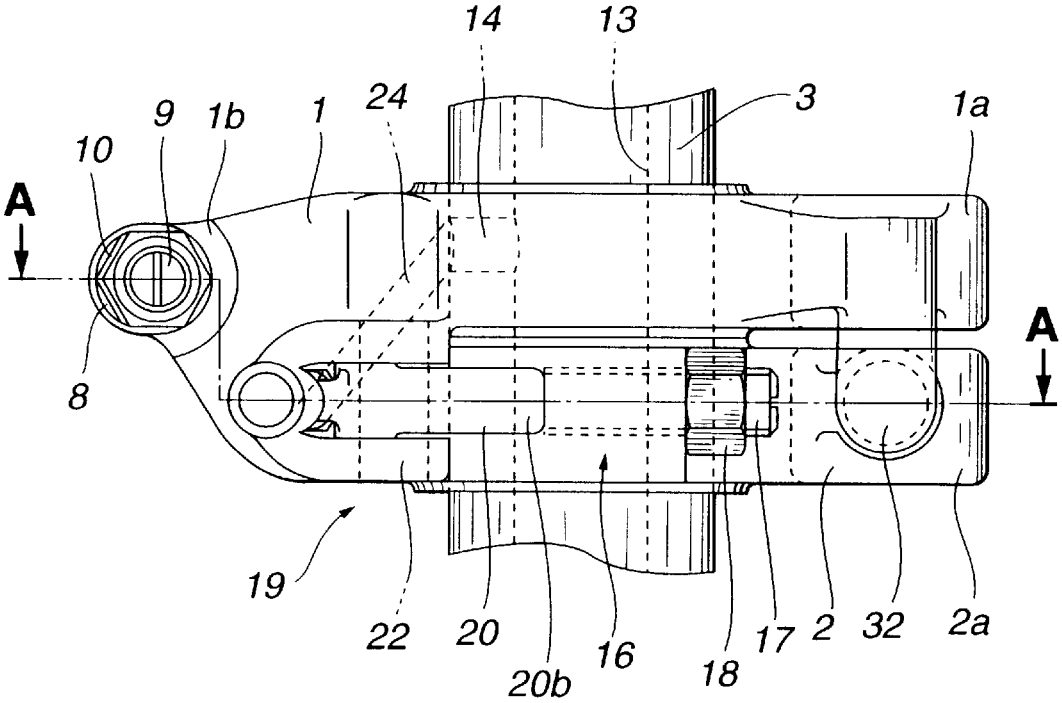
FIG. 1 is a plan view of an exhaust brake according to the present invention, showing a condition wherein a second contacting unit is in operation.

As is understood from FIGS. 1 and 6, the brake rocker arm 2 is identical in shape to a right portion 1*a* of the exhaust rocker arm 1. More specifically, the brake rocker arm 2 and the right portion 1*a* of the exhaust rocker arm 1 are the same in shape. A right end 2*a* of the brake rocker arm 2 is formed with a cam follower 12 which contacts a brake cam 11.

Referring back to FIG. 4, the rocker shaft 3 is formed with an axially extending oil gallery 13 and a radially extending bore 14 which extends from the oil gallery 13.

Figure 5:
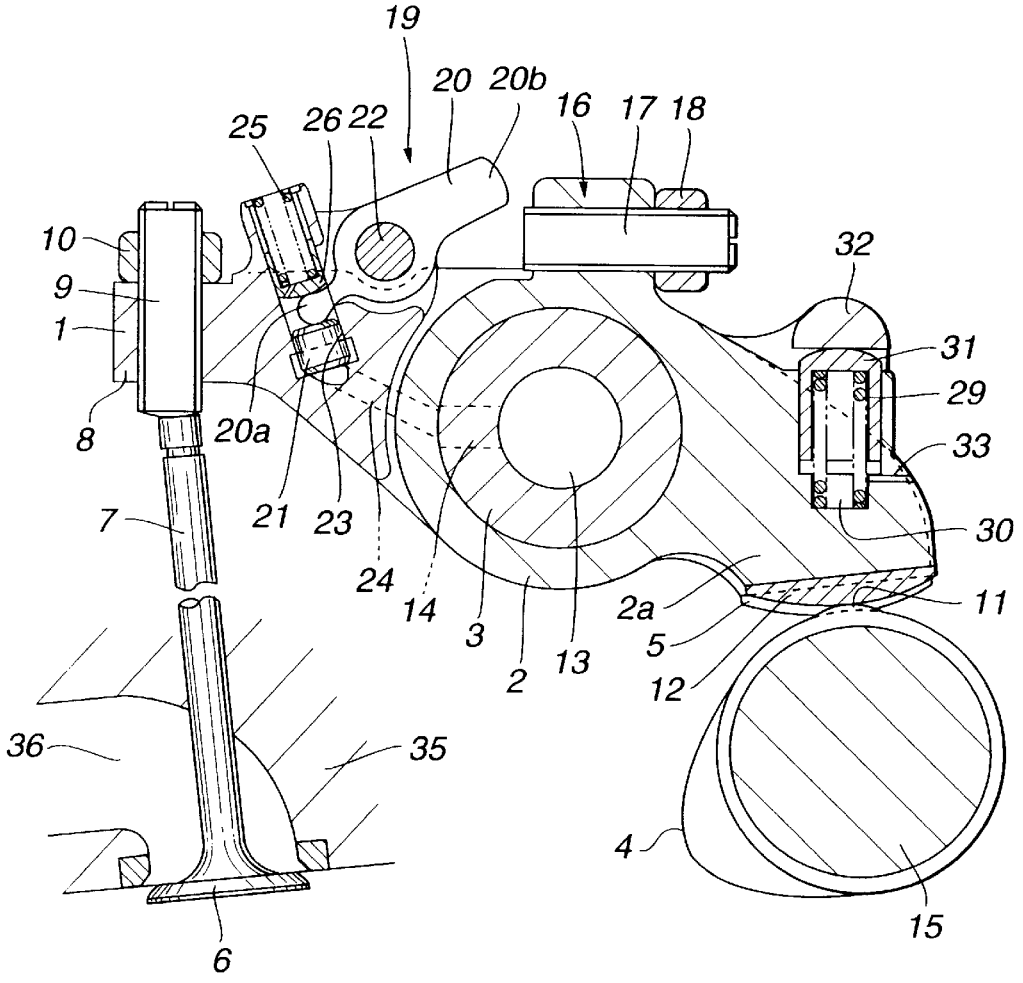
FIG. 5 is a view similar to FIG. 4, but showing a condition wherein with the second contacting unit being in operation, the brake cam pivots the brake rocker arm.

The exhaust cam 4 and the brake cam 11 are formed on axially spaced portions of a common cam shaft 15 and arranged to operatively contact the respective cam followers 5 and 12 of the exhaust rocker arm 1 and the brake rocker arm 2, as is seen from FIG. 5.

In FIG. 4, designated by numeral 16 is a first contacting unit supported by the brake rocker arm 2. As shown, the first contacting unit 16 is provided on an upwardly projected portion (no numeral) of the brake rocker arm 2. The first contacting unit 16 comprises an adjusting screw 17 axially movably held by the projected portion and a nut 18 engaged with the adjusting screw 17. Thus, by rotating the screw 17 about its axis, an effective length of the same can be adjusted. As shown, the adjusting screw 17 extends in a direction perpendicular to the axis of the s rocker shaft 3.

Designated by numeral 19 is a second contacting unit provided on the exhaust rocker arm 1. The second contacting unit 19 comprises a lever 20 which can contact a head of the adjusting screw 17 of the first contacting unit 16. A hydraulic plunger 21 is operatively held in the exhaust rocker arm 1, which actuates the lever 20. As shown, the lever 20 is pivotally connected at its generally middle portion to the exhaust rocker arm 1 by means of a pin 22. The hydraulic plunger 21 is axially movably received in a cylindrical bore 23 formed in the exhaust rocker arm 1.

A small spherical left end 20*a* of the lever 20 is in contact with an upper end or head of the hydraulic plunger 21, so that up-and-down movement of the plunger 21 in the cylindrical bore 23 induces a pivotal movement of the lever 20 about the pin 22. The spherical shape of the left end 20*a* reduces or minimizes a frictional force inevitably produced when contacting the hydraulic plunger 21. A right end 20*b* of the lever 20 is contactable with the head of the adjusting screw 17. As shown, the right end 20*b* of the lever 20 is shaped convexly. Due to this convex shape, slipping movement of the right end 20*b* relative to the head of the adjusting screw 17 is smoothly carried out.

Into the cylindrical bore 23, there is led an operation oil from the oil gallery 13 through the bore 14 formed in the rocker shaft 3 and an oil passage 24 formed in the exhaust rocker arm 1. In an upper portion of the cylindrical bore 23, there is slidably disposed a hollow plunger 26 whose bottom is in contact with the small spherical left end 20*a* of the lever 20. A return spring 25 is put in the recess of the plunger 26 to press the plunger 26 against the spherical left end 20*a*, so that the spherical left end 20*a* of the lever 20 is biased toward the hydraulic plunger 21. As shown, the bottom of the plunger 26 that is in contact with the spherical left end 20*a* of the lever 20 is shaped convexly. Due to this convex shape, relative slipping movement between the plunger 26 and the left end 20*a* is smoothly achieved.

In FIG. 4, designated by numeral 29 is a coil spring which is disposed between the exhaust rocker arm 1 and the brake rocker arm 2 for biasing these two rocker arms 1 and 2 in opposite directions. The coil spring 29 is put in a blind bore 30 formed in the right end portion 2*a* of the brake rocker arm 2. The blind bore 30 is communicated with the atmosphere through a small passage 33 formed in the brake rocker arm 2. A hollow plunger 31 is put on the coil spring 29 having an upper portion of the spring 29 received in the hollow thereof. A convex head portion of the plunger 31 is in contact with a flat lower surface of an arm 32 extending from the exhaust rocker arm 1. Due to the force of the coil spring 29, the exhaust and brake rocker arms 1 and 2 are biased to pivot about the rocker shaft 3 in counterclockwise and clockwise directions respectively, so that the second contacting unit 19 on the exhaust rocker arm 1 and the first contacting unit 16 of the brake rocker arm 2 are biased away in opposite directions, that is, in the directions to be separated from each other.

Designated by numeral 37 is an oil feeding passage through which the oil is fed to the oil gallery 13 from an oil pan 38. An oil pump 39 and a control valve 40 are arranged in the oil feeding passage 37. The control valve 40 is controlled by a control unit 41 for adjusting the amount of oil fed to the oil gallery 13.

In the following, operation will be described with reference to the drawings.

Figure 3:
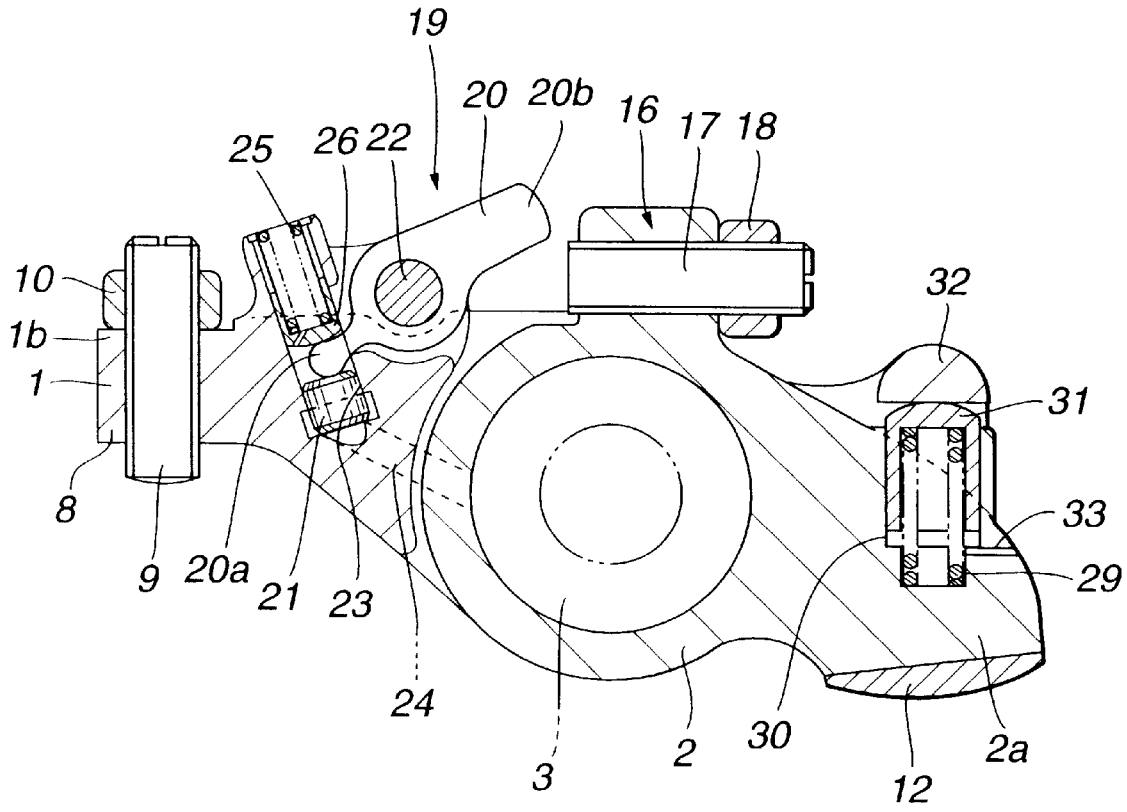
FIG. 3 is a view similar to FIG. 2, but showing a condition wherein the second contacting unit is not in operation.

Under normal operation of the engine wherein the exhaust braking is not needed, the second contacting unit 19 does not operate. That is, under this condition, the second contacting unit 19 assumes a rest position as shown in FIGS. 3 and 5. Thus, even when the brake rocker arm 2 is pivoted by the brake cam 11 (see FIG. 5), the pivoting movement of the brake rocker arm 2 is not transmitted to the exhaust rocker arm 1. That is, under such normal condition, the exhaust valve 6 is actuated by only the exhaust rocker arm 1 pivoted by the exhaust cam 4. In other words, in this normal condition of the engine, the exhaust rocker arm 1 and the brake rocker arm 2 are not coupled.

More specifically, as is seen from FIG. 5, in such normal condition, the hydraulic plunger 21 assumes its lowermost position due to shortage of oil fed to the cylindrical bore 23. Thus, the lever 20 is forced to assume an inclined inoperative position by the force of the return spring 25. Thus, even if the adjusting screw 17 is moved leftward due to counterclockwise pivoting of the brake rocker arm 2, the head of the screw 17 does not contact the right end 20*b* of the lever 20.

Figure 2:
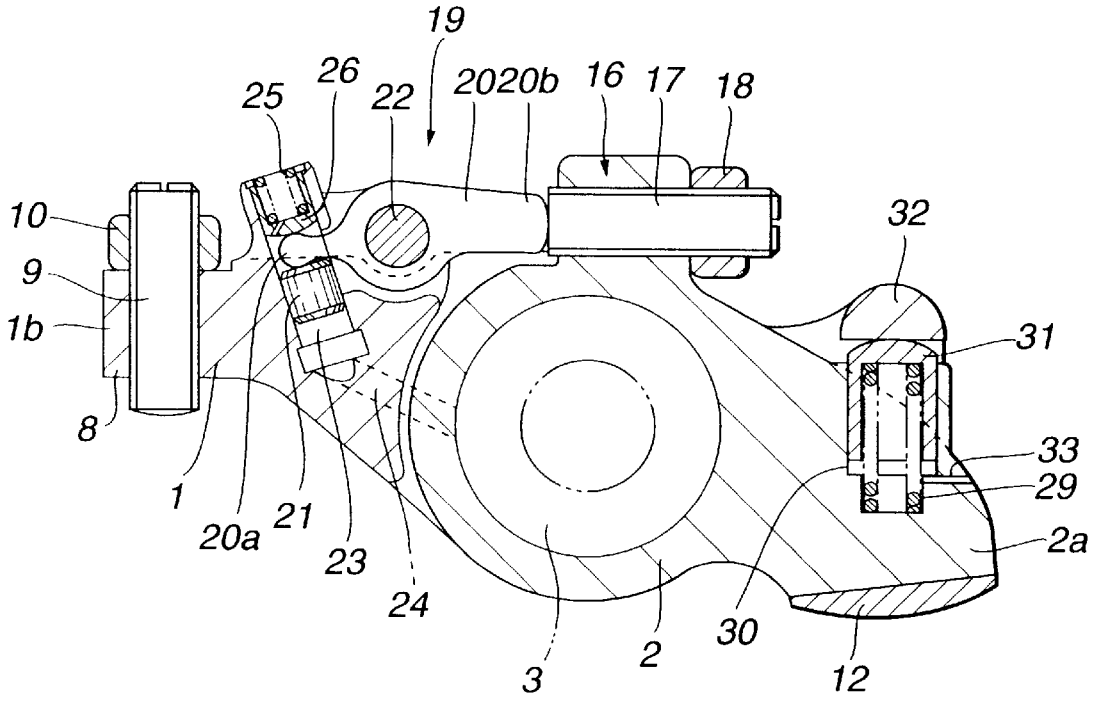
FIG. 2 is a sectional view taken along the line "A—A" of FIG. 1.

While, under a brake condition of the engine wherein the exhaust braking is needed, the second contacting unit 19 operates. That is, under this condition, the second contacting unit 19 assumes a work position as shown in FIG. 2, 4 and 6. Thus, when the brake rocker arm 2 is pivoted by the brake arm 11 (see FIG. 4), the pivoting movement of the brake rocker arm 2 is transmitted to the exhaust rocker arm 1 through the operated second contacting unit 19. That is, under such brake condition, the exhaust valve 6 is actuated by both the exhaust rocker arm 1 and the brake rocker arm 2.

More specifically, as is understood from FIG. 4, when, upon receiving an instruction signal from the control unit 41, the control valve 40 works to increase the amount of oil fed to the oil gallery 13, the pressure in the cylindrical bore 23 is increased and thus the hydraulic plunger 21 is moved up together with the spherical left end 20*a* of the lever 20 against the force of the return spring 25. Thus, the lever 20 is pivoted clockwise and finally assumes the operative position as shown.

In this operative condition of the second contacting unit 19, the head of the adjusting screw 17 can abut against the right end 20*b* of the lever 20 when the brake rocker arm 2 is pivoted counterclockwise by the lobe of the brake cam 11.

However, as is seen from FIG. 6, while the cam follower 12 of the brake rocker arm 2 is contacting a portion other than the lobe of the brake cam 11, the head of the adjusting screw 17 is away from the right end 20*b* of the lever 20 keeping a predetermined space therebetween. It is to be noted that the space can be adjusted by turning the adjusting screw 17. It is further to be noted that, as has been mentioned hereinabove, due to the force of the coil spring 29, the adjusting screw 17 on the brake rocker arm 2 is biased away from the lever 20 on the exhaust rocker arm 1.

Accordingly, as is seen from FIG. 6, for a time when with the second contacting unit 19 being in operation, the head of the adjusting screw 17 is away from the right end 20*b* of the lever 20, the exhaust rocker arm 1 is actuated by only the exhaust cam 4. That is, for that limited time, the exhaust valve 6 is controlled by only the exhaust cam 4. In other words, during this time, the movement of the exhaust valve 6 is the same as that achieved under normal operation of the engine wherein the exhaust braking is not needed.

That is, for the time when with the second contacting unit 19 being in operation for inducing the exhaust braking, the head of the adjusting screw 17 is away from the right end 20*b* of the lever 20, the exhaust rocker arm 1 and the brake rocker arm 2 are independent from each other and thus the inertia mass of the valve actuating mechanism is substantially equal to that provided under the normal operation of the engine.

While, when with the second contacting unit 19 being in operation, the lobe of the brake cam 11 is brought into abutment with the cam follower 12 of brake rocker arm 2, the head of the adjusting screw 17 abuts against the right end 20*b* of the lever 20 as is seen from FIGS. 1 and 2. Upon this, the brake rocker arm 2 and the exhaust rocker arm 1 become coupled, so that the counterclockwise pivoting of the brake rocker arm 2 by the lobe of the brake cam 11 is transmitted to the exhaust rocker arm 1.

Thus, as is seen from FIG. 4, the exhaust valve 6 is forced to open slightly or instantly for effecting the exhaust braking.

Of course, also in the present invention, suitable measures are employed for inducing a crack or instant opening of the exhaust valve 6 at the end of the compression stroke.

In the following, advantages of the present invention will be briefly described.

First, the inertia mass of the valve actuating mechanism at a normal exhaust period when the exhaust cam 4 swings the exhaust rocker arm 1 to open the exhaust valve 6 shows substantially no change between the two cases, one being a case wherein the exhaust braking is needed and the other being a case wherein the exhaust braking is not needed. In other words, the exhaust brake of the present invention has substantially no influence on the movement of the exhaust valve 6 at the normal exhaust period.

Second, since the coupling of the brake rocker arm 2 and the exhaust rocker arm 1 is achieved by only contacting the adjusting screw 17 to the lever 20, there is no need of using a complicated coupling structure. Thus, the exhaust brake of the present invention is readily and economically manufactured.

Third, due to usage of the adjusting screw 17, the effective distance between the adjusting screw 17 and the lever 20 is adjustable, which can control the operation timing of the exhaust braking.

Fourth, due to nature of the hydraulic plunger 21, the second contacting unit 19 can exhibit a responsive operation.

Fifth, due to provision of the coil spring 29 which biases the two rocker arms 1 and 2 in opposite directions, undesired play of the brake rocker arm 2, which would occur when the coupled connection therebetween is not established, is assuredly suppressed.

In the following, modifications of the present invention will be described.

If desired, contrary to the above-mentioned arrangement, the adjusting screw 17 and the second contacting unit 19 may be mounted to the exhaust and brake rocker arms 1 and 2, respectively.

Furthermore, if desired, the screw supporting portion 8 of the exhaust rocker arm 1 may be equipped with a lash controlling device for adjusting contact between the adjusting screw 9 and the valve step 7.

The entire contents of Japanese Patent Application P10-367334 (filed Dec. 24, 1998) are incorporated herein by reference.

Although the invention has been described above with reference to a certain embodiment of the invention, the invention is not limited to the embodiment. Various modifications and variations of the embodiment will occur to those skilled in the art, in light of the above teachings.

What is claimed is:

1. An exhaust brake incorporated with an internal combustion engine, comprising:

an exhaust rocker arm actuated by an exhaust cam for operating an exhaust valve;

a brake rocker arm actuated by a brake cam;

a first contacting unit held by either one of said exhaust and brake rocker arms;

a second contacting unit held by the other of said exhaust and brake rocker arms, said second contacting unit being contactable with said first contacting unit when an exhaust braking is needed; and a coupling structure which, only when the brake rocker arm is actuated by said brake cam upon need of the exhaust braking, induces the contact between said second and first contacting units to provide an integral action of said exhaust and brake rocker arms thereby to actuate the exhaust valve for establishing the exhaust braking.

2. An exhaust brake as claimed in claim 1, in which said first contacting unit comprises an adjusting means for adjusting an effective distance between said first and second contacting units.

3. An exhaust brake as claimed in claim 2, in which said adjusting means comprises an adjusting screw which is axially movably held by either one of said exhaust and brake rocker arms and a nut which is engaged with said adjusting screw, said adjusting screw having a head contactable with said second contacting unit.

4. An exhaust brake as claimed in claim 1, in which said second contacting unit comprises:

a lever having a portion contactable with said first contacting unit; and a hydraulic plunger for pivotally actuating said lever.

5. An exhaust brake as claimed in claim 1, further comprising a biasing structure which is arranged between said exhaust and brake rocker arms to bias these two rocker arms in a direction to separate said first and second contacting units away from each other.

6. An exhaust brake as claimed in claim 5, in which said biasing structure comprises:

a blind bore formed in one of the exhaust and brake rocker arms;

an arm provided by the other of the exhaust and brake rocker arms;

a coil spring received in said blind bore; and a hollow plunger put on said coil spring and contacting with said arm.

7. An exhaust brake as claimed in claim 6, in which said hollow plunger has a convex head which is in contact with a flat surface of said arm.

8. An exhaust brake as claimed in claim 1, in which said second contacting unit comprises:

a lever pivotally connected to the other of said exhaust and brake rocker arms, said lever having a first end contactable with said first contacting unit;

a cylindrical bore formed in the other of said exhaust and brake rocker arms, said bore being communicated with an oil gallery formed in a rocker shaft;

a plunger slidably received in said cylindrical bore, said plunger having a head contactable with a second end of said lever; and a spring member for biasing said second end of said lever against the head of said plunger.

9. An exhaust brake as claimed in claim 8, in which said first end of said lever is convex in shape and said second end of said lever is spherical in shape.

* * * * *